US005688144A

United States Patent [19]

Kosuge

[11] Patent Number: 5,688,144

[45] Date of Patent: Nov. 18, 1997

[54] CONNECTION COVER

[75] Inventor: Shuji Kosuge, Yokkaichi, Japan

[73] Assignee: Sumitomo Wiring Systems, Ltd., Japan

[21] Appl. No.: 577,828

[22] Filed: Dec. 22, 1995

[30] Foreign Application Priority Data

Dec. 27, 1994 [JP] Japan ..... 6-325222

[51] Int. Cl.[6] ..... H01R 13/40

[52] U.S. Cl. ..... 439/596; 439/902; 439/466

[58] Field of Search ..... 439/596, 466, 439/467, 468, 902

[56] References Cited

U.S. PATENT DOCUMENTS 3,920,306 11/1975 Barnett et al. ..... 439/466

5,315,062 5/1994 Hoshino ..... 439/466

*Primary Examiner*—Neil Abrams

*Assistant Examiner*—T. C. Patel

*Attorney, Agent, or Firm*—Anthony J. Caselle; Gerald E. Hespos; Ludomir A. Budzyn

[57] ABSTRACT

A connector cover includes a cover main body 6A is formed with a connector receptacle **6*b* for accommodating a connector 1 inserted through an upper opening 6*a*, a corrugate tube receptacle 6*d* for accommodating a corrugate tube 4 inserted through an upper opening 6*c*, and an intermediate wire portion receptacle 6*j* for accommodating intermediate wire portions 3*a* between the connector 1 and the wires 3 inserted through an upper opening 6*k*. A lid 6B is formed with a connector/wire covering portion 6*h* which is unitarily formed with the cover main body 6A by way of a hinge 6*e* and is adapted to close the upper openings 6*a* and 6*k* of the connector receptacle 6*b* and the intermediate wire portion receptacle 6*j* and lockingly engage the cover main body 6A. A corrugate tube covering portion 6*i* is unitarily formed with the connector/wire covering portion 6*h* by way of a hinge 6*m* and is adapted to close the upper opening 6*c* of the corrugate tube receptacle 6*d* and lockingly engage the main body 6A**.

10 Claims, 5 Drawing Sheets

CONNECTION COVER

BACKGROUND OF THE INVENTION

1. Field of the Invention

The present invention relates to a connection cover for accommodating a connection, such as a connector mounted at an end of a wire. The connector cover is particularly designed to improve operability when the connector is assembled with the wire or a corrugate tube.

2. Description of the Prior Art

A known connector cover of this type is shown in FIG. 4 and is identified generally by the numeral 2.

The connector cover 2 includes a cover main body 2A and a lid 2B. The cover main body 2A and the lid 2B are made integral by way of a thin hinge **2*e***.

The cover main body 2A includes a connector receptacle **2*b* for accommodating a connector 1 inserted through an upper opening 2*a*, a corrugate tube receptacle 2*d* for accommodating a corrugate tube 4 fitted on wires 3 and inserted through an upper opening 2*c*, and an intermediate wire portion receptacle 2*j* for accommodating intermediate wire portions 3*a* between the connector 1 and the corrugate tube 4 through an upper opening 2*k***.

The lid 2B includes a connector/wire covering portion **2*h* for lockingly closing the upper openings 2*a* and 2*k* of the connector receptacle 2*b* and the intermediate wire portion receptacle 2*j* by the engagement of a locking claw 2*f* of the cover main body 2A and a locking hole 2*g*, and a corrugate tube covering portion 2*i* for closing the upper opening 2*c* of the corrugate tube receptacle 2*d***.

With the connector cover 2, after the connector 1, the corrugate tube 4 and the intermediate wire portions **3*a* are set in the connector receptacle 2*b*, the corrugate tube receptacle 2*d* and the intermediate wire portion receptacle 2*j* through the upper openings 2*a*, 2*c* and 2*k*, respectively, the openings 2*a*, 2*k* and 2*c* are simultaneously closed by the lid 2B. Accordingly, one has to simultaneously hold the corrugate tube 4 and the intermediate wire portions 3*a* with one hand so as to prevent the corrugate tube 4 from being displaced and the intermediate wire portions 3*a* from coming out, while closing the lid 2B** with the other hand. This causes a problem of poor assembling operability.

In view of the above problem, a connector cover 5 as shown in FIG. 5 was proposed (see Japanese Unexamined Utility Model Publication No. 4-51017). The connector cover 5 is divided into an intermediate wire portion receptacle 5A and a connector receptacle 5B. After the connector receptacle 5B is connected with the intermediate wire portion receptacle 5A, for example, by connecting means **5*a* and 5*b* and a connector 1 is set in the connector receptacle 5B through a window 5*c*, the window 5*c* is closed by a lid 5*d***.

However, for this connector cover 5, the intermediate wire portion receptacle 5A and the connector receptacle 5B need to be formed as separate parts, thereby necessitating the connecting means **5*a* and 5*b* for connecting the receptacles 5A and 5B**. This leads to a complicated construction and an increased production cost.

Thus, it is an object of the invention to provide an improved connection cover having an improved operability and which can be fabricated at a reduced cost, in particular to provide an improved connector cover with which a connector can be assembled with a wire or a corrugate tube with an improved operability and which can be fabricated at a reduced cost.

SUMMARY OF THE INVENTION

According to the invention, there is provided a connection cover for accommodating a connection, in particular a connector mounted at ends of at least one wire, comprising: a main body comprising: a first receptacle means for accommodating a first portion of the connection, a second receptacle means for accommodating a second portion of the connection, and a third receptacle means for accommodating a third portion of the connection, and a lid comprising: a first cover means being pivotably connectable, in particular pivotably connected or integrally formed with the main body by means of a first hinge means and being adapted to cover at least partly the first and third receptacle means and a second cover means being pivotably connectable, in particular pivotably connected or integrally formed with the first cover means by means of a second hinge means and being adapted to cover at least partly the second receptacle means.

According to a preferred embodiment, the third portion is arranged between the first portion and the second portion.

Preferably, the first portion of the connection is inserted through a first opening, in particular upper opening of the first receptacle means, and/or the second portion of the connection is inserted through a second opening, in particular upper opening of the second receptacle means, and/or the third portion of the connection is inserted through a third opening, in particular upper opening of the third receptacle means.

Further preferably, the first cover means is adapted to cover at least partly the first opening and/or the third opening and the second cover means is adapted to cover at least partly the second opening.

Further preferably, the first receptacle means is a connector receptacle for accommodating the first portion of the connection being a connector, wherein the third receptacle means preferably is an intermediate wire portion receptacle for accommodating the third portion of the connection being at least one intermediate portion of at least one wire, wherein the first cover means further preferably is a connector/wire covering portion.

According to a further preferred embodiment, the second receptacle means is a corrugate tube receptacle for accommodating the second portion of the connection being a corrugate tube, which is in particular fitted on at least one wire, or a wire portion receptacle for accommodating the second portion of the connection being a wire portion, wherein the second cover means preferably is a corrugate tube covering portion or a wire covering portion.

Further preferably, the first cover means and/or the second cover means lockingly engages or engage the main body.

According to a preferred embodiment, the connector cover for accommodating a connector mounted at ends of wires comprises a main body comprising a connector receptacle for accommodating a connector inserted through an upper opening thereof, a corrugate tube receptacle for accommodating a corrugate tube fitted on the wires and inserted through an upper opening thereof, and an intermediate wire portion receptacle for accommodating intermediate portions of the wires between the connector and the corrugate tube inserted through an upper opening thereof; and a lid comprising a connector/wire covering portion which is unitarily formed with the main body by way of a hinge and is adapted to close the upper openings of the connector receptacle and the intermediate wire portion receptacle and lockingly engage the main body, and a corrugate tube covering portion which is unitarily formed with the connector/wire covering portion by way of a hinge and is adapted to close the upper opening of the corrugate tube receptacle and lockingly engage the main body.

Accordingly, after the connector, the corrugate tube and the intermediate wire portion are set in the connector receptacle, the corrugate tube receptacle and the intermediate wire portion receptacle, respectively, the upper openings of the connector receptacle and the intermediate wire portion receptacle are simultaneously closed by the connector/wire covering portion of the lid.

At this stage, while holding the intermediate wire portions with one hand lest it should come out, the connector/wire covering portion is closed with the other hand. Accordingly, it is not necessary to hold the corrugate tube in the corrugate tube receptacle simultaneously with the intermediate wire portions.

Thereafter, while holding the corrugate tube in the corrugate tube receptacle with one hand lest it should be displaced, the corrugate tube covering portion is closed with the other hand.

As described above, since it is not necessary to simultaneously hold the corrugate tube and the intermediate wire portions during closing of the lid, assembling operability can be improved.

Further, since the main body and the lid can be unitarily formed, the connector cover is allowed to have a simple structure and can be fabricated at a reduced cost.

As is clear from the above description, the connector, the corrugate tube and the intermediate wire portions are set in the connector receptacle, the corrugate tube receptacle and the intermediate wire portion receptacle, respectively. Then, while holding the intermediate wire portions with one hand lest it should come out, the connector/wire covering portion of the lid is manuvered with the other hand to close the upper openings of the connector receptacle and the intermediate wire portion receptacle. Thereafter, while holding the corrugate tube in the corrugate tube receptacle with one hand lest it should be displaced, the corrugate tube covering portion is closed with the other hand. Since it is not necessary to simultaneously hold the corrugate tube and the intermediate wire portion with one hand during closing of the lid, assembling operability can be improved.

Further, since the cover main body and the lid can be unitarily formed, the connector cover is allowed to have a simple construction and can be fabricated at a reduced cost.

According to a further preferred embodiment, the connector cover for accommodating a connector mounted at ends of wires comprises a main body comprising a connector receptacle for accommodating a connector inserted through an upper opening thereof, a wire receptacle for accommodating the wires inserted through an upper opening thereof, and an intermediate wire portion receptacle for accommodating intermediate portions of the wires between the connector and the corrugate tube inserted through an upper opening thereof; and a lid comprising a connector/wire covering portion which is unitarily formed with the main body by way of a hinge and is adapted to close the upper openings of the connector receptacle and the intermediate wire portion receptacle and lockingly engage the main body, and a wire covering portion which is unitarily formed with the connector/wire covering portion by way of a hinge and is adapted to close the upper opening of the wire receptacle and lockingly engage the main body.

Accordingly, after the connector, the wires and the intermediate wire portions are set in the connector receptacle, the wire receptacle and the intermediate wire portion receptacle, respectively, the upper openings of the connector receptacle and the intermediate wire portion receptacle are simultaneously closed by the connector/wire covering portion of the lid.

At this stage, while holding the intermediate wire portion with one hand lest it should come out, the connector/wire covering portion is closed with the other hand. Accordingly, it is not necessary to hold the wires in the corrugate tube receptacle simultaneously with the intermediate wire portions.

Thereafter, while holding the corrugate tube in the corrugate tube receptacle with one hand lest it should be displaced, the corrugate tube covering portion is closed with the other hand.

Accordingly, while holding the intermediate wire portion with one hand, the connector/wire covering portion is closed with the other hand. Thereafter, while holding the wire in the wire receptacle with one hand lest it should be displaced, the wire covering portion is closed with the other hand. Thus, the connector cover of this embodiment has the same actions and effects as the one of the preceding embodiment.

These and other objects, features and advantages of the present invention will become more apparent upon a reading of the following detailed description and accompanying drawings.

DETAILED DESCRIPTION OF THE PREFERRED EMBODIMENT

Figure 1A:
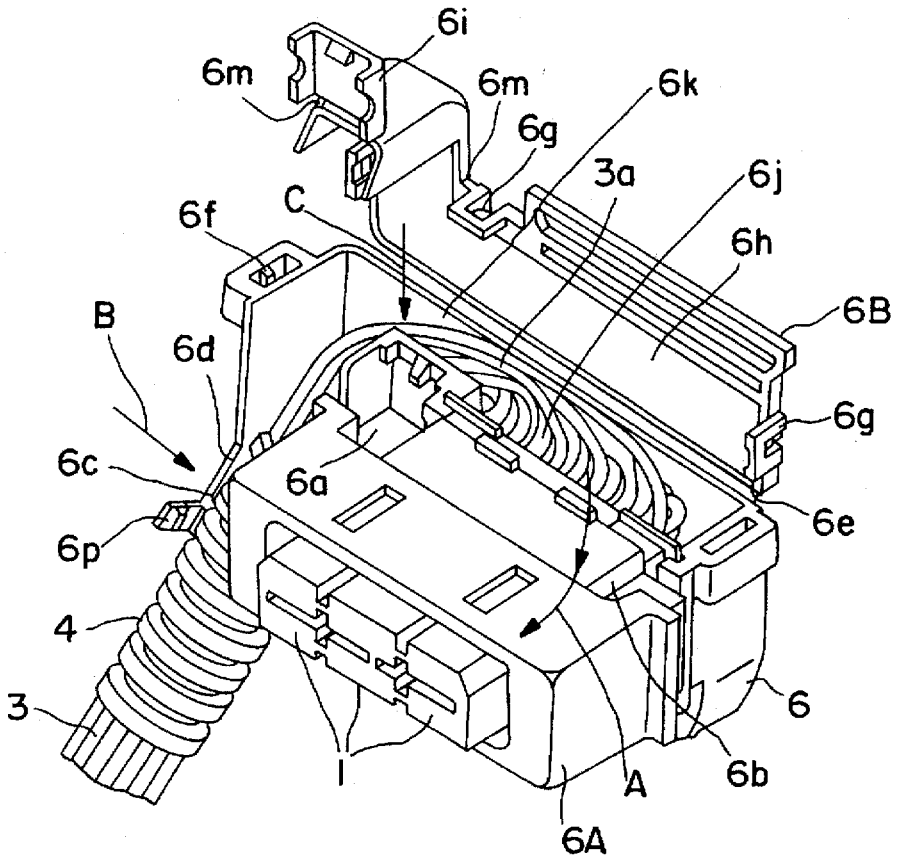
FIGS. 1(A) and 1(B) are perspective views of a connector cover according to a preferred embodiment of the invention when a lid is open and when it is closed, respectively.

Hereafter, the invention is described by way of one illustrated embodiment.

No detailed description is given to elements of the embodiment having the same construction and action as the prior art shown in FIG. 4(A) to 5(C) by identifying them by the same reference numerals.

Figure 1B:
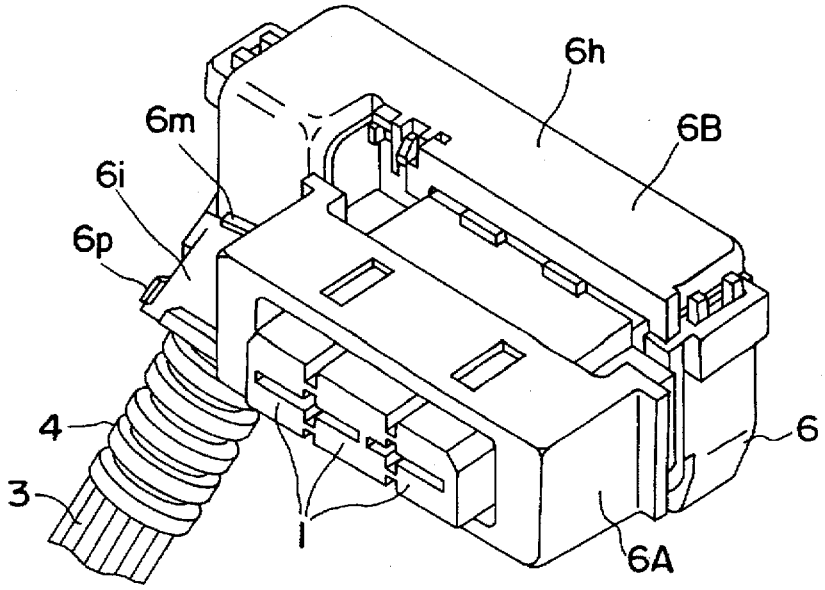
Figure 2A:
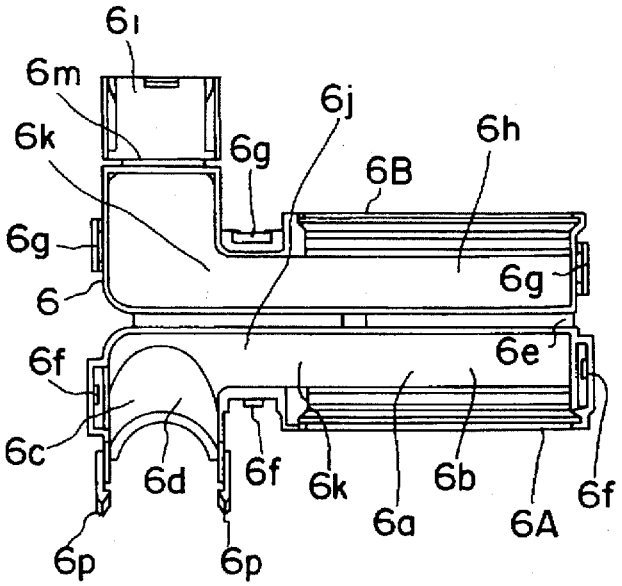
FIGS. 2(A), 2(B) and 2(C) are plan, side and front views of the connector cover.
Figure 2B:
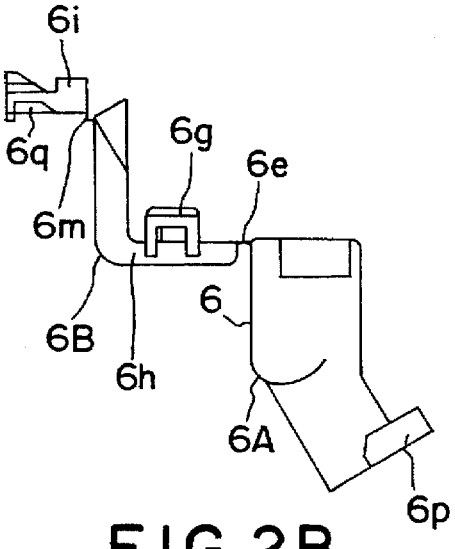
Figure 2C:
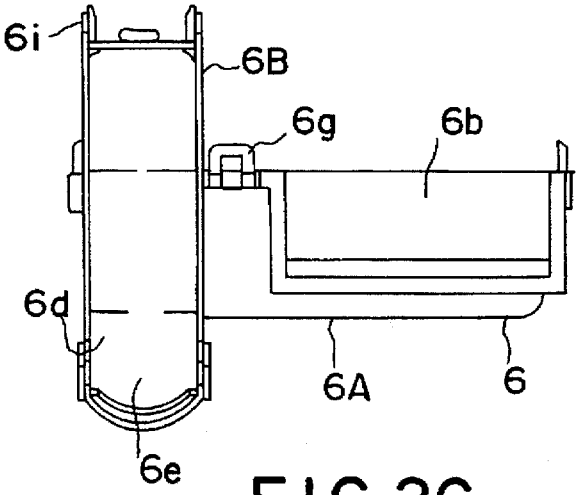

As shown in FIGS. 1 and 2, a connector cover 6 of synthetic resin consists essentially of a cover main body 6A and a lid 6B.

The cover main body 6A is formed with a connector receptacle *6b* for accommodating a connector 1 which is inserted through an upper opening 6a as indicated by an arrow A in FIG. 1(A).

At one longitudinal end of the connector receptacle *6b*, there is formed a semicircular corrugate tube receptacle *6d* for accommodating a corrugate tube 4 fitted on wires 3 and inserted through an upper opening 6c as indicated by an arrow B in FIG. 1(A).

Between the connector receptacle 6b and the corrugate tube receptacle 6d, there is formed an intermediate wire portion receptacle 6j for accommodating intermediate portions 3a of the wires 3 between the connector 1 and the corrugate tube 4 which are inserted through an upper opening 6k as indicated by an arrow C in FIG. 1(A).

The lid 6B is unitarily formed with the cover main body 6A by way of a thin hinge 6e. The lid 6B is formed with a connector/wire covering portion 6h for closing the upper openings 6a and 6k of the connector receptacle 6b and the intermediate wire portion receptacle 6j.

The connector/wire covering portion 6h is, at one end thereof, integrally, in particular unitarily formed with a corrugate tube covering portion 6i by way of a thin hinge 6m. The covering portion 6i is adapted to close the upper opening 6c of the corrugate tube receptacle 6d of the cover main body 6A.

Figure 3A:
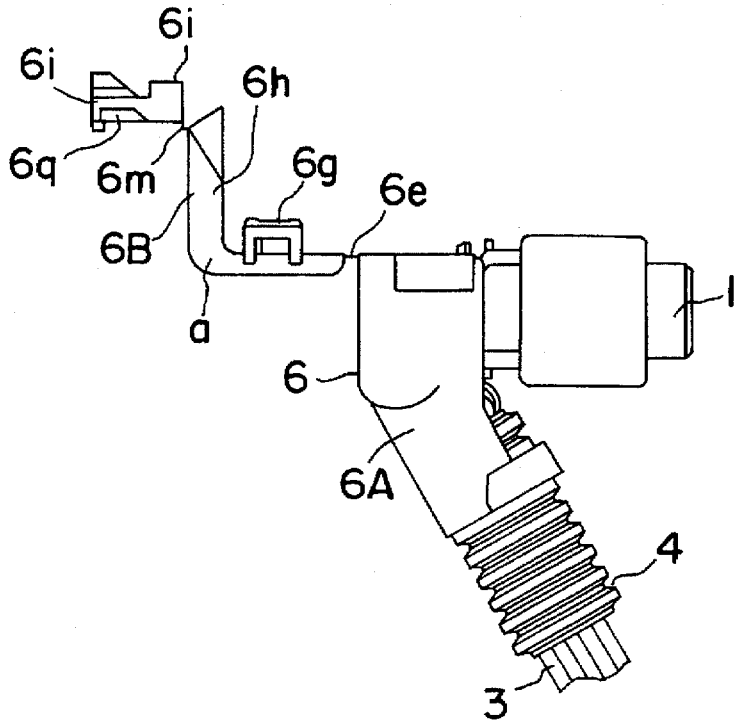
FIG. 3(A) is a side view of the connector cover when the lid is opened and a connector is set.
Figure 3B:
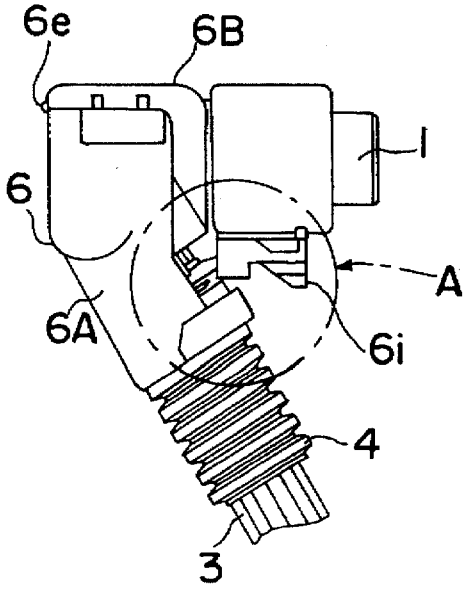
FIG. 3(B) is a side view of the connector cover when the lid is closed.
Figure 3C:
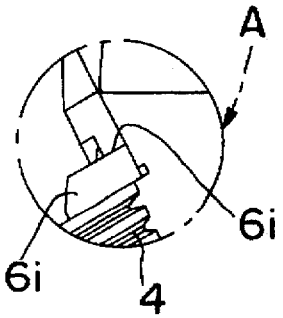
FIG. 3(C) is a side view of an essential portion of a portion A in FIG. 3(B) when a corrugate tube covering portion is closed.
Figure 4A:
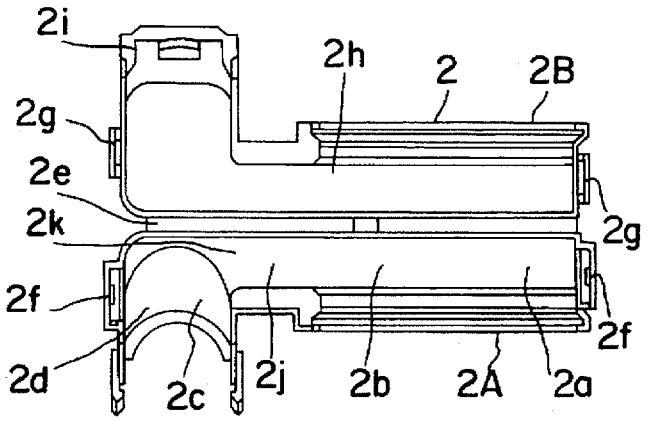
FIG. 4A PRIOR ART
FIGS. 4(A), 4(B) and 4(C) are plan, front and side views of a prior art connector cover.
Figure 4C:
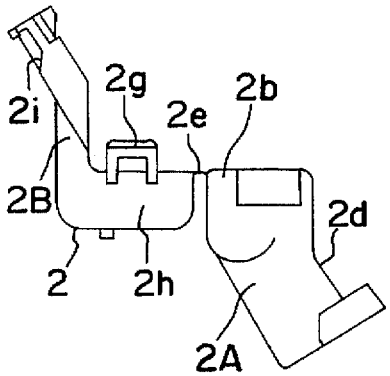
FIG. 4C PRIOR ART
Figure 4B:
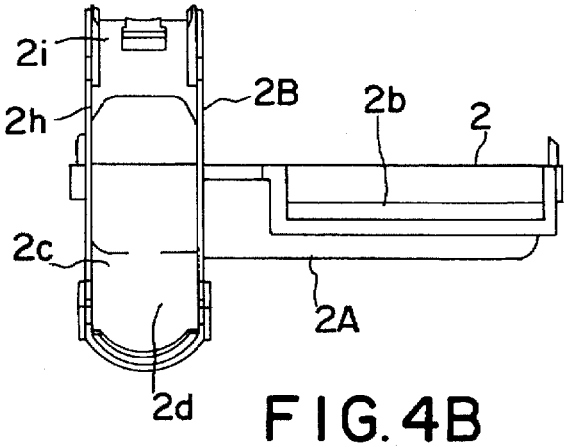
FIG. 4B PRIOR ART
Figure 4D:
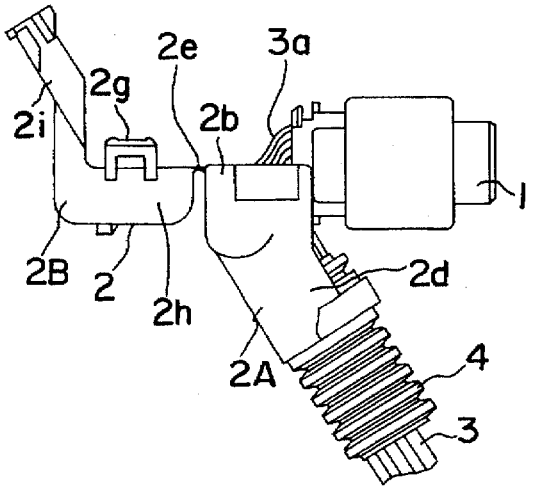
FIG. 4D PRIOR ART
FIGS. 4(D) and 4(E) are side views of the prior art connector cover when a lid is opened and a connector is set and when the lid is closed, respectively.
Figure 4E:
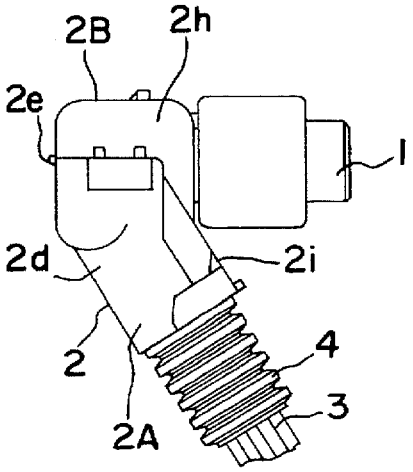
FIG. 4E PRIOR ART
Figure 5A:
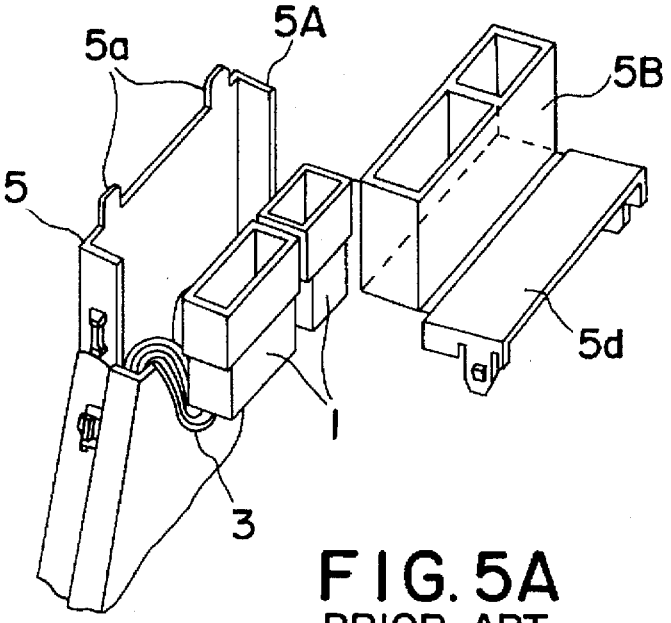
FIG. 5A PRIOR ART
FIG. 5(A) is a perspective view of another prior art connector cover.
Figure 5B:
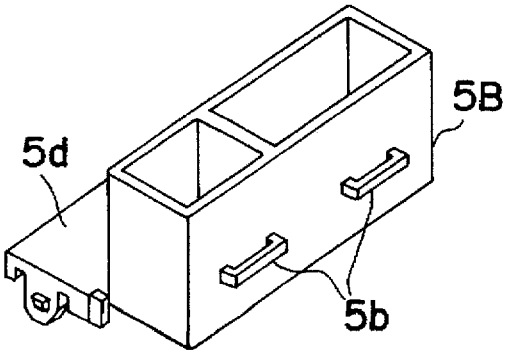
FIG. 5B PRIOR ART
FIG. 5(B) is a perspective view of a connector receptacle.
Figure 5C:
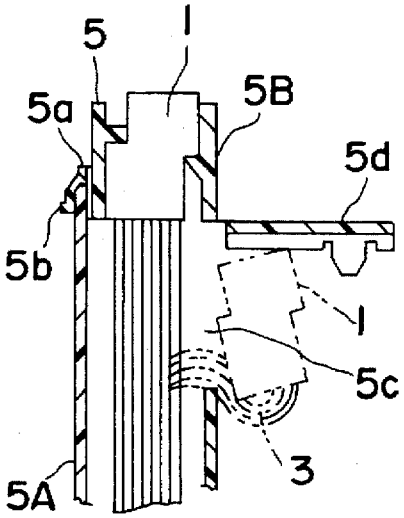
FIG. 5C PRIOR ART
FIG. 5(C) is a side view in section of this prior art connector cover.

The connector/wire covering portion 6h is formed, in specified positions thereof, with at least one locking hole 6g for engaging at least one locking claw 6f of the cover main body 6A, respectively when the upper openings 6a and 6k are closed by the connector/wire covering portion 6h as shown in FIG. 3(A).

The corrugate tube covering portion 6i is formed, in a specified position thereof, with a locking portion 6q for lockingly engaging a locking claw 6p of the cover main body 6A when the upper opening 6c is closed by the corrugate tube covering portion 6i.

With the connector cover 6 thus constructed, during assembling, the connector 1 is inserted and set in the connector receptacle 6b through the upper opening 6a with the openings 6a, 6c and 6k of the cover main body 6A open.

The corrugate tube 4 fitted on the wires 3 is inserted and set in the corrugate tube receptacle 6d through the upper opening 6c.

Further, the intermediate portions 3a of the wires 3 are inserted and set in the intermediate wire portion receptacle 6j through the upper opening 6k.

Thereafter, the upper openings 6a and 6k of the connector receptacle 6b and the intermediate wire portion receptacle 6j are simultaneously closed by the connector/wire covering portion 6h of the lid 6B, using the hinge 6e. Then, the connector/wire covering portion 6h is locked with the cover main body 6A by the engagement of the locking claw 6f and the locking hole 6g.

At this stage, while holding the intermediate wire portions 3a with one hand lest they should come out, the connector/wire covering portion 6h is closed with the other hand to close the openings 6a and 6k. It is not necessary to hold the corrugate tube 4 with the one hand lest it should be displaced. In other words, displacement of the corrugate tube 4 while the connector/wire covering portion 6h is being closed does not cause any problem.

Thereafter, while holding the corrugate tube 4 with one hand lest it should be displaced, the corrugate tube covering portion 6i is maneuvered with the other hand to close the opening 6c of the corrugate tube receptacle 6d, using the hinge 6m. Then, the corrugate tube covering portion 6i is locked with the cover main body 6A by the engagement of the locking claw 6p and the locking portion 6q.

As described above, since it is not necessary to simultaneously hold the intermediate wire portions 3a and the corrugate tube 4 with one hand during closing of the lid 6B, assembling operability can be improved.

Further, since the cover main body 6A and the lid 6B can be integrally, in particular unitarily formed, the connector cover is allowed to have a simple structure and can be fabricated at a reduced cost.

In the foregoing embodiment, after the corrugate tube 4 fitted on the wires 3 is set in the corrugate tube receptacle 6d, the corrugate tube covering portion 6i is closed. However, when no corrugate tube 4 is mounted, the corrugate tube receptacle 6d and the corrugate tube covering portion 6i may be used as a wire portion receptacle and a wire covering portion, respectively. Then, after the wires 3 are set in the wire receptacle, the opening of the wire receptacle may be closed by the wire covering portion.

Further, in the foregoing embodiment, a bent portion a (see FIG. 3(A)) at the side of the corrugate covering portion 6i of the connector/wire covering portion 6h may be integrally, in particular unitarily formed by way of a thin hinge.

Although the intermediate portions 3a of the wires 3 connected with the connector 1 are bent in L-shape in the foregoing embodiment, it should be appreciated that the invention is applicable to the assembly in which the wires 3 extend straight from the connector 1.

What is claimed is:

1. A connection cover for accommodating a connection comprising:

a main body (6A) comprising:

a first receptacle means (6b) for accommodating a first portion of the connection, a second receptacle means (6d) for accommodating a second portion of the connection, and a third receptacle means (6j) for accommodating a third portion of the connection; and a lid (6B) comprising:

a first cover means (6h) pivotably connectable with the main body (6A) by means of a first hinge joint (6e) for covering at least partly the first and third receptacle means (6b, 6j) and a second cover means (6i) pivotably connectable with the first cover means (6h) by means of a second hinge joint (6m) for permitting said second receptacle means (6d) to remain uncovered until after said first cover means (6h) covers said first and third receptacle means (6b, 6j), and for subsequently permitting pivotable movement of said second cover means relative to said first cover means for covering at least partly the second receptacle means (6d), said second hinge joint (6m) being substantially parallel to said first hinge joint (6e).

2. A connection cover according to claim 1, wherein the first cover means (6h) and the second cover means (6i) lockingly engage the main body (6A).

3. A connection cover according to claim 1, wherein the third portion is arranged between the first portion and the second portion.

4. A connection cover according to claim 3, wherein the first portion of the connection is inserted through a first opening (6a) of the first receptacle means (6b), and/or the second portion of the connection is inserted through a second opening (6c) of the second receptacle means (6d), and the third portion of the connection is inserted through a third opening (6k) of the third receptacle means (6j).

5. A connection cover according to claim 4, wherein the first cover means (6h) is adapted to cover at least partly the first opening (6a) and the third opening (6k) and the second cover means (6*i*) is adapted to cover at least partly the second opening (6*c*).

6. A connection cover according to claim 1, wherein the first portion of the connection comprises a connector (1), the second and third portions of the connection comprising a wires (3) extending from the connector (1), and wherein the first receptacle means (6*b*) is a connector receptacle (6*b*) for accommodating the connector (1).

7. A connection cover according to claim 6, wherein the third receptacle means (6*j*) is an intermediate wire portion receptacle (6*j*) for accommodating at least one intermediate portion (3*a*) of the wire (3).

8. A connection cover according to claim 7, wherein the first cover means (6*h*) is a connector/wire covering portion (6*h*) dimensioned and configured to cover the connector (1) and the intermediate portion of the wire (3).

9. A connection cover according to claim 7, wherein the second portion of the connection further comprises a corrugate tube (4) fitted on a portion of the wire (3) and wherein the second receptacle means (6*d*) is a corrugate tube receptacle (6*d*) for accommodating the corrugate tube (4).

10. A connection cover according to claim 9, wherein the second cover means (6*i*) is a corrugate tube covering portion (6*i*) dimensioned and configured to cover the corrugate tube (4).

* * * * *